US010633236B1

(12) United States Patent
Harris et al.

(10) Patent No.: US 10,633,236 B1
(45) Date of Patent: Apr. 28, 2020

(54) CAN OPENING SYSTEM

(71) Applicant: Absolute Machine Enterprises, Incorporated, Ridgeway, VA (US)

(72) Inventors: Charles M. Harris, Ridgeway, VA (US); Jared P. Harris, Ridgeway, VA (US); Joshua E. Harris, Ridgeway, VA (US); Levi Z. Harris, Ridgeway, VA (US)

(73) Assignee: Absolute Machine Enterprises, Incorporated, Ridgeway, VA (US)

( * ) Notice: Subject to any disclaimer, the term of this patent is extended or adjusted under 35 U.S.C. 154(b) by 242 days.

(21) Appl. No.: 15/876,320

(22) Filed: Jan. 22, 2018

Related U.S. Application Data

(60) Provisional application No. 62/554,682, filed on Sep. 6, 2017.

(51) Int. Cl.
*B67B 7/44* (2006.01)
*B67B 7/00* (2006.01)

(52) U.S. Cl.
CPC . *B67B 7/38* (2013.01); *B67B 7/24* (2013.01)

(58) Field of Classification Search
CPC ..... B67B 7/38; B67B 7/24
See application file for complete search history.

(56) References Cited

U.S. PATENT DOCUMENTS

| | | | | |
|---|---|---|---|---|
| 3,487,965 | A | 1/1970 | Gale | 214/152 |
| 3,821,850 | A * | 7/1974 | Kowalyk | B67B 7/38 30/410 |
| 4,396,340 | A | 8/1983 | Clinton | 414/412 |
| 5,358,376 | A | 10/1994 | Van Den Top | 414/412 |
| 5,682,681 | A * | 11/1997 | Cincotta | B67B 7/38 29/426.4 |
| 7,162,786 | B2 * | 1/2007 | Rice | B09B 3/0058 100/240 |

* cited by examiner

*Primary Examiner* — Jonathan Snelting
(74) *Attorney, Agent, or Firm* — MacCord Mason PLLC

(57) ABSTRACT

A can opening system and method for removing the contents of a plurality of cans. The can opening system includes a housing adapted to receive a can and shield an operator from equipment within the housing, a top clamping assembly within the housing adapted to clamp onto a top edge of the can, a bottom clamping assembly within the housing configured to clamp against a lower side of the can, a punch cutter above the top and bottom clamping assemblies for extracting and retaining a lid of the can, and a punch tip within the housing adapted to puncture a bottom of the can and dispense the remaining contents of the can. The can opening system is adapted to remove up to about 90% of contents of a can for materials having a viscosity up to about 250,000 Centipoise.

35 Claims, 16 Drawing Sheets

CAN OPENING SYSTEM

This application claims the benefit of provisional application No. 62/554,682, filed Sep. 6, 2017, which is incorporated herein by reference in its entirety.

FIELD OF THE TECHNOLOGY

The present inventions relate generally to can opening systems and, more particularly, to a can opening system for removing contents from a plurality of cans.

BACKGROUND

Canning products is a popular method for storing perishable items for prolonged periods of time. In some instances, the can or its contents may become unsatisfactory for a variety of reasons. For example, the contents may have expired, failed to meet certain quality standards, or the cans may have become damaged. In such scenarios, the cans are shipped to a facility where they are opened, the contents are removed, and then the cans are separately discarded.

In other instances, a large volume of cans may need to be opened to dispense contents for further use. For example, the contents of the cans may contain one or more ingredients for a larger mixture. The contents of the cans need to be quickly opened and dispensed, comprising one step of a larger process.

Current can opening systems have a variety of disadvantages. For instance, industrial can openers typically need large amounts of space (e.g., 400 square feet) and require separate bins to dispose of the cans and their respective lids. Moreover, the amount of cans processed by these systems amount to approximately 200 cans per hour, and are not adapted to remove viscous contents from cans. Safety issues also plague many existing can opening systems.

Thus, Applicant desires a can opening system for the effective removal of viscous contents within the can, while, at the same time, providing an efficient can and lid disposal operation.

SUMMARY

In accordance with the present disclosure, a can opening system and method is provided for removing the contents of a can, and more particularly, wherein the contents of the can are viscous. This disclosure provides improved methods and systems that are efficient while remaining safe for the operator.

The present inventions are directed to a can opening system for removing the contents of a plurality of cans. The can opening system is adapted to open and remove the contents for a variety of sized cans, including for example, a #10 can. The can opening system includes a housing adapted to receive a can and shield an operator from equipment within the housing, a top clamping assembly within the housing adapted to clamp onto a top edge of the can, a bottom clamping assembly within the housing configured to clamp against a lower side of the can, a punch cutter above the top and bottom clamping assemblies for extracting and retaining a lid of the can, and a punch tip within the housing adapted to puncture a bottom of the can and dispense the remaining contents of the can. The punch tip may include one or more holes to expel air and remove additional contents from the can. The housing may include a time-delayed interlocked door for safety purposes preventing access during the can opening system's operation.

Accordingly, one embodiment of the present disclosure includes a bottom clamping assembly comprising a bottom clamp attached to a piston configured to extend and clamp the can when the can is initially positioned below the punch cutter. After the lid is removed, the bottom clamp is configured to contract and release the can. The bottom clamp may be substantially crescent-shaped.

The top clamping assembly may comprise a floor adapted to be positioned below the can, a sidewall having a height substantially equal to a height of the can and a top clamp on top of the first sidewall. The floor may include a hole adapted for the punch tip to extend through. In one embodiment, the top clamp is attached to a piston that extends to clamp the can and contracts to release the top clamp from the can. For example, the top clamp may comprise a notch adapted for receiving a lip on the top edge of the can. The top clamping assembly may be attached to a rotary actuator adapted to rotate the top clamping assembly with the can 180 degrees.

A gravity roller conveyor system may be included for inserting a plurality of cans into the housing. A chute may be added to the can opening system for the plurality of cans to exit the housing once their contents have been removed.

In some embodiments, a guide block may be used to guide the can onto the chute after the can is opened and dispensed. A stop may be added onto the guide block to prevent a second can from displacing the can before its contents are dispensed.

The punch cutter may comprise a plate with a plurality of blades arranged perpendicularly from the plate in a crown-like configuration and forming a cavity. For example, the punch cutter may include six blades. After the lid is removed from the can, the lid may be retained within the cavity formed from the plurality of blades. In one embodiment, the punch cutter includes an ejector cylinder adapted to release the lid from the plurality of blades. For instance, the plate may further include a hole, with the ejector cylinder overlapping the hole and adapted to extend through the hole on the plate. A punch spear may be attached to the center of the punch cutter for puncturing the lid to release air from the can and prevent overspray of its contents.

The present inventions may also include methods for processing cans. For example, the method may comprise clamping a lower portion of a can, removing a lid from the can, clamping an upper portion of the can, rotating the can into an off-centered position thereby emptying a first portion of its contents, puncturing the lower portion with a punch tip, expelling air from one or more holes on the punch tip to remove additional contents from the can, and rotating the can to its original orientation. The can opening assembly may be adapted to process about 450 cans per hour.

The method may comprise loading a plurality of cans into a can opening assembly with a gravity feed conveyor system. In one embodiment of the disclosure, the method may comprise aligning a first can from the plurality of cans under a cutter adapted to cut and remove a lid from the first can, and may also include a step for pushing the first can away from the cutter after its contents are removed and aligning a second can under the cutter.

The can may be rotated about 180 degrees from a first orientation to the off-centered orientation to empty the majority of the can's contents. For example, rotating the can to empty a first portion of its contents may comprise removing between about 50% to about 80% of the contents of the can. The method may include the step of retaining the lid when removing the lid from the can, and may also include inserting the lid inside of the can after rotating the can to its original orientation. Once the can is opened and its contents are dispensed, the method may further comprise disposing of the can and the lid into a single bin.

The methods may include steps for removing viscous contents from a can. In one example, air may be expelled from one or more holes of the punch tip at a pressure between about 80 PSI and about 120 PSI. For instance, the air may be expelled at a pressure of about 110 PSI. Expelling air from the one or more holes on the punch tip may remove up to 90% of the total contents of the can. For example, contents having a viscosity of between about 0 to about 250,000 Centipoise at 68° F. may have up to about 90% of the contents removed. For instance, about 90% of the contents removed has a viscosity between about 1 to about 20,000 Centipoise at 68° F. In another example, about 75% of the contents removed has a viscosity between about 100,000 to about 250,000 Centipoise at 68° F.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF THE PREFERRED EMBODIMENTS

Figure 1:
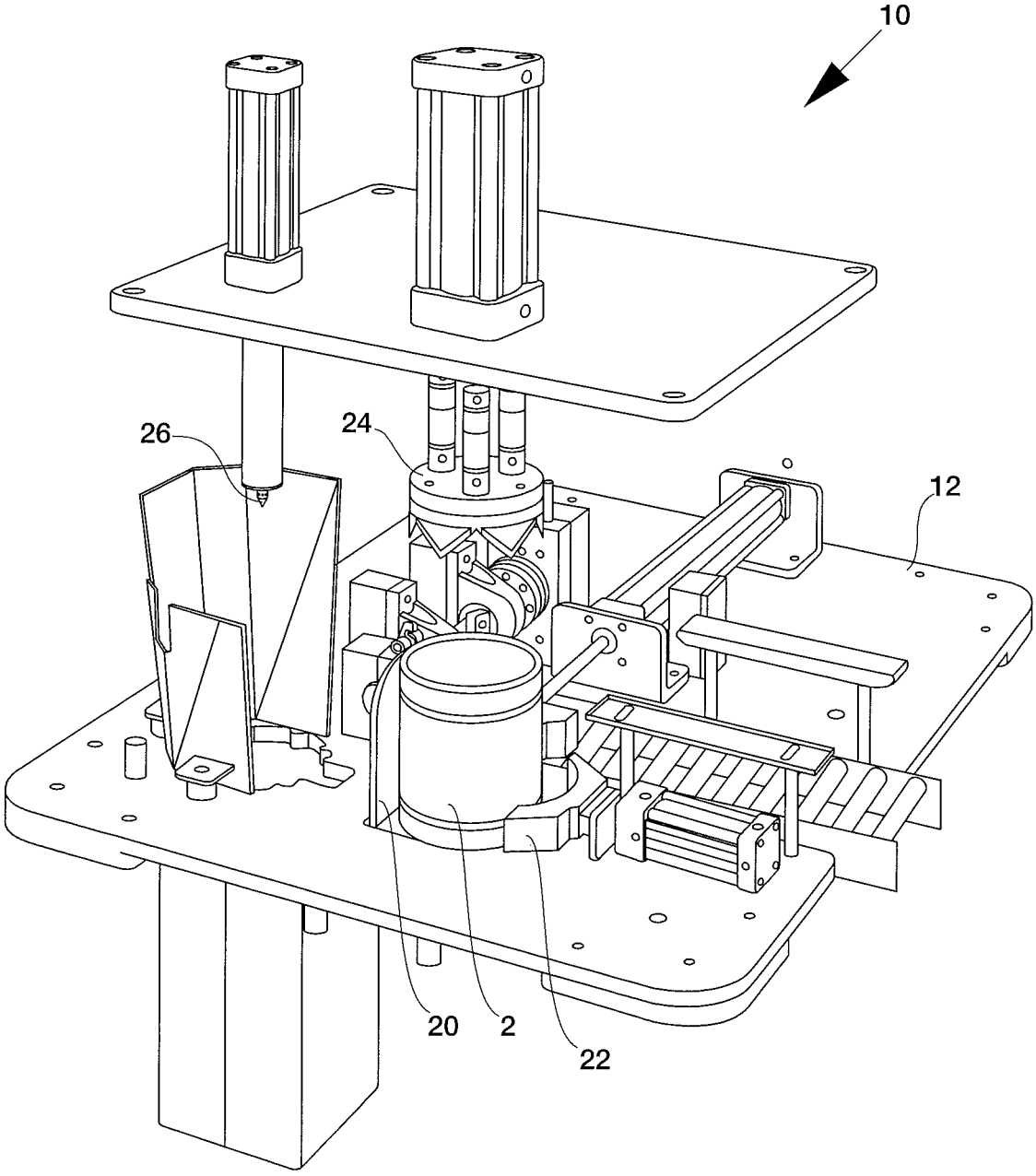
FIG. 1 is an enlarged side perspective view of a can opening system constructed according to one embodiment of the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing an embodiment of the invention and are not intended to limit the inventions thereto. As seen in FIG. 1, a can opening system, generally designated 10, is shown constructed according to the present inventions. The can opening system 10 is designed for removing the contents from a can 2, and includes a housing 12, a top clamping assembly 20, a bottom clamping assembly 22, a punch cutter 24 and a punch tip 26.

Figure 2:
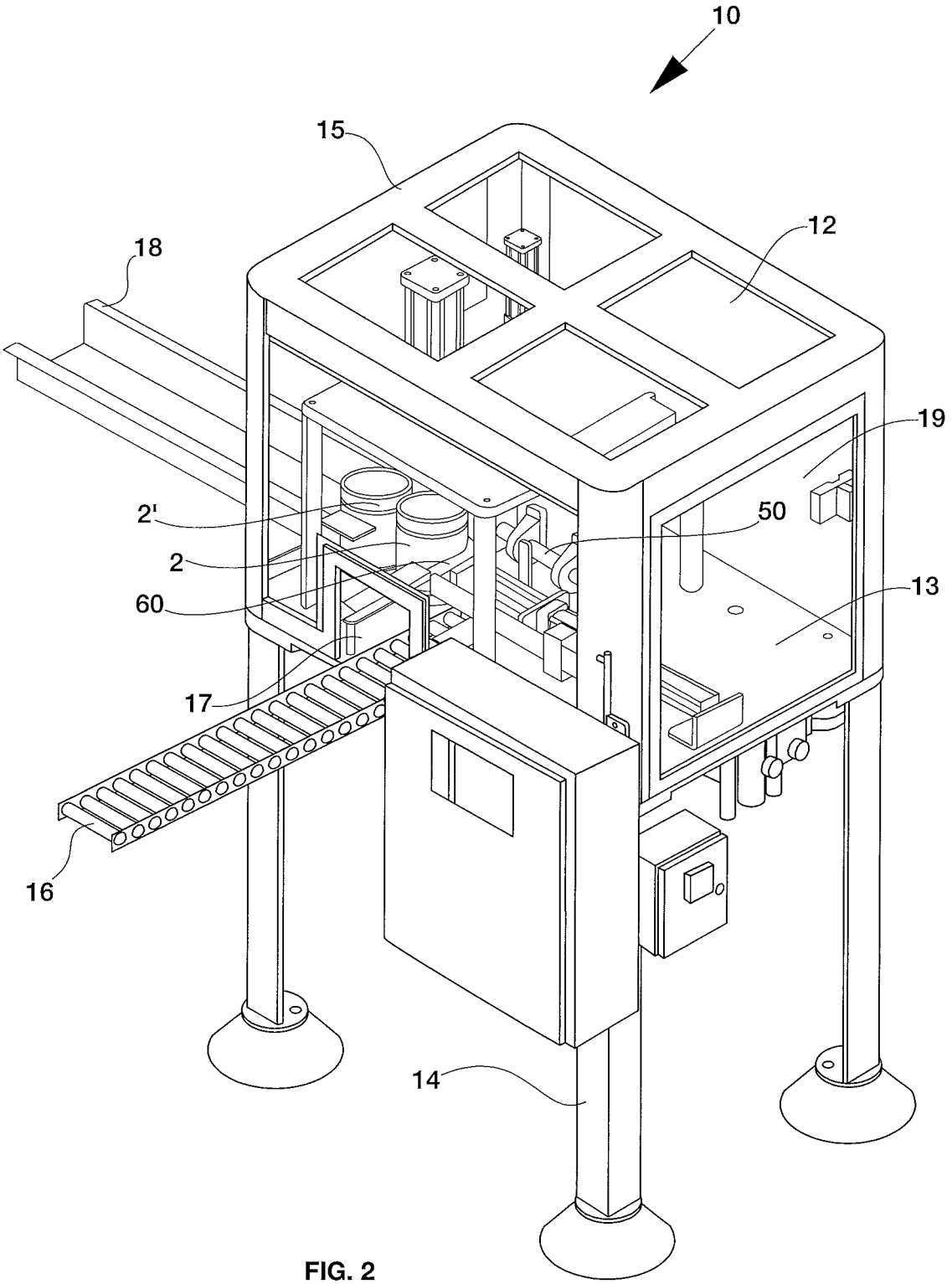
FIG. 2 is an overhead perspective view of a can opening system constructed according to one embodiment of the present inventions.

Turning to the embodiment shown in FIG. 2, the housing 12 includes a platform 13 and an outer casing 15 for shielding an operator from the equipment and other contents within. In the embodiment shown, the platform 13 is supported by a plurality of legs 14. The outer casing 15 is preferably constructed from a stainless steel mesh, but may alternatively be constructed of other materials. For example, the outer casing 15 may comprise a shatterproof material, such as abrasion resistant polycarbonate sheets. A time-delayed interlocked door 19 may also be included as a safety feature with the outer casing 15 to prevent untimely access to the contents within the outer casing 15. Various components of the system may be mounted onto the outside of the outer casing 15; for example, an electrical cabinet and power box may be mounted onto the housing 12.

The outer casing 15 may include openings 17 for the cans to enter and exit the outer casing. A conveyor system 16 may be included near one opening to direct a plurality of cans onto the platform 13. In one embodiment, the conveyor system 16 is a gravity roller conveyor system. A chute 18 may be included near a second opening to direct the plurality of cans off the platform 13.

Figure 3:
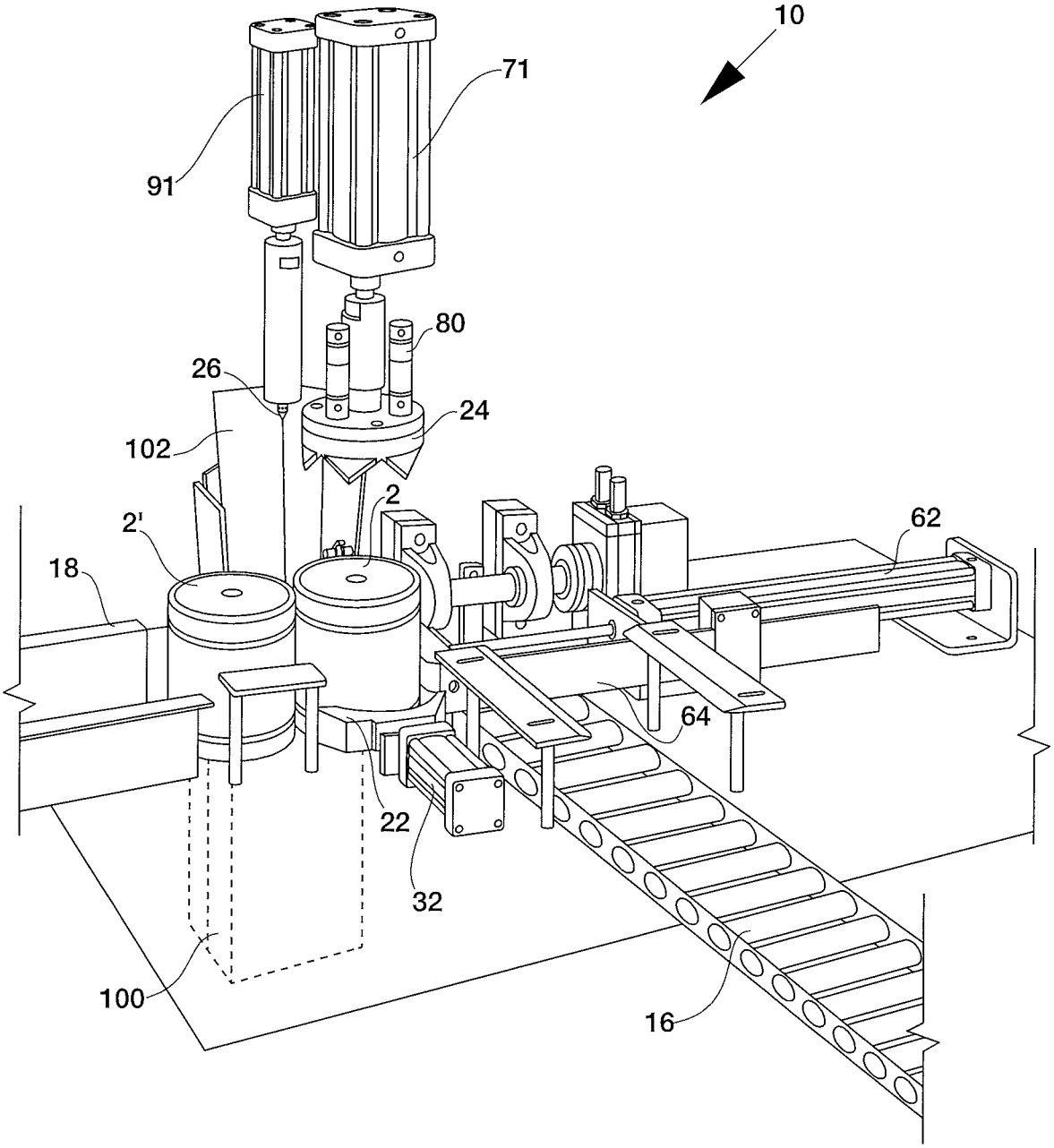
FIG. 3 is an enlarged front perspective view of the can opening system shown in FIG. 2.
Figure 4:
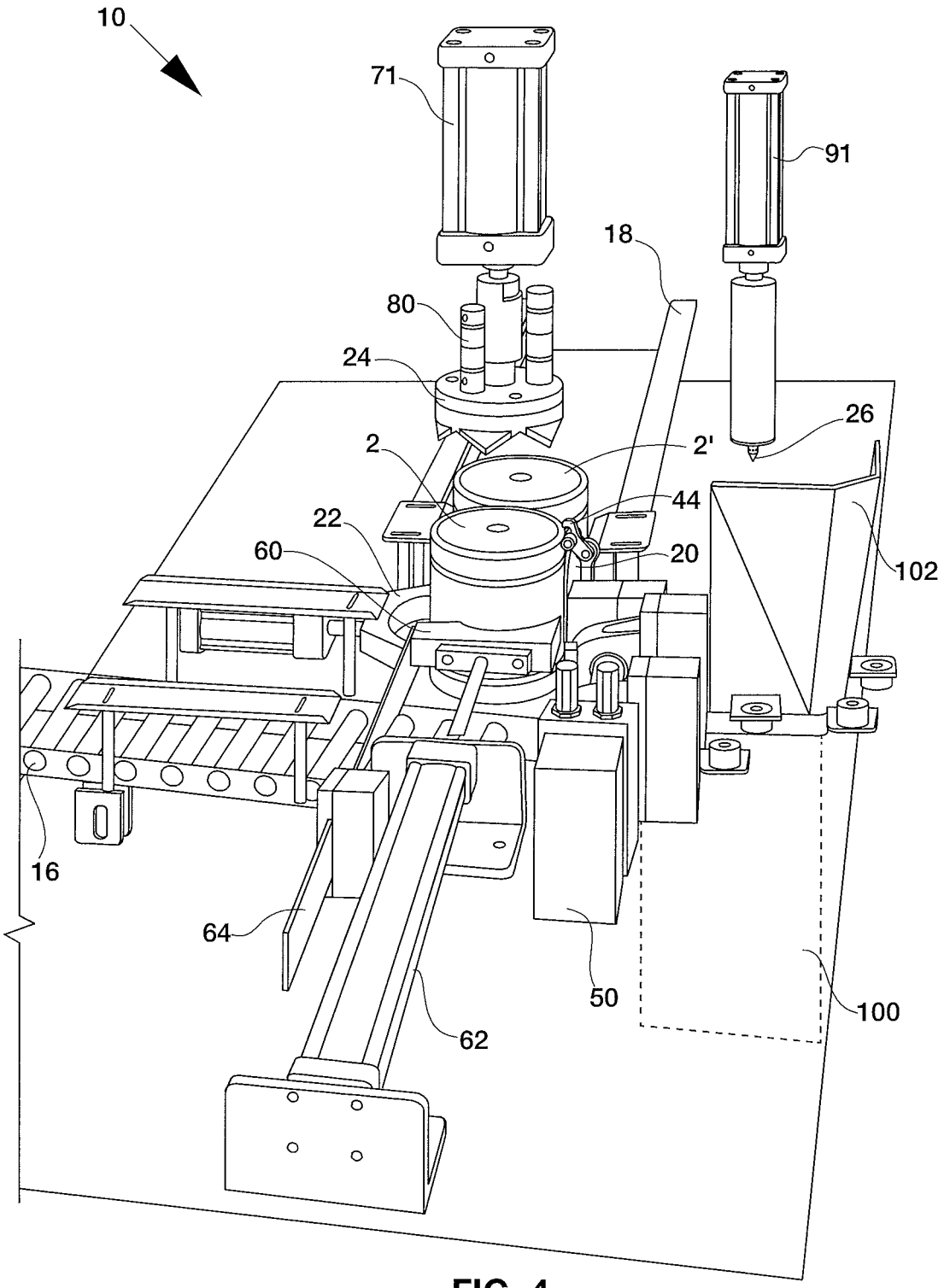
FIG. 4 is an enlarged side perspective view of the can opening system shown in FIG. 2.
Figure 5:
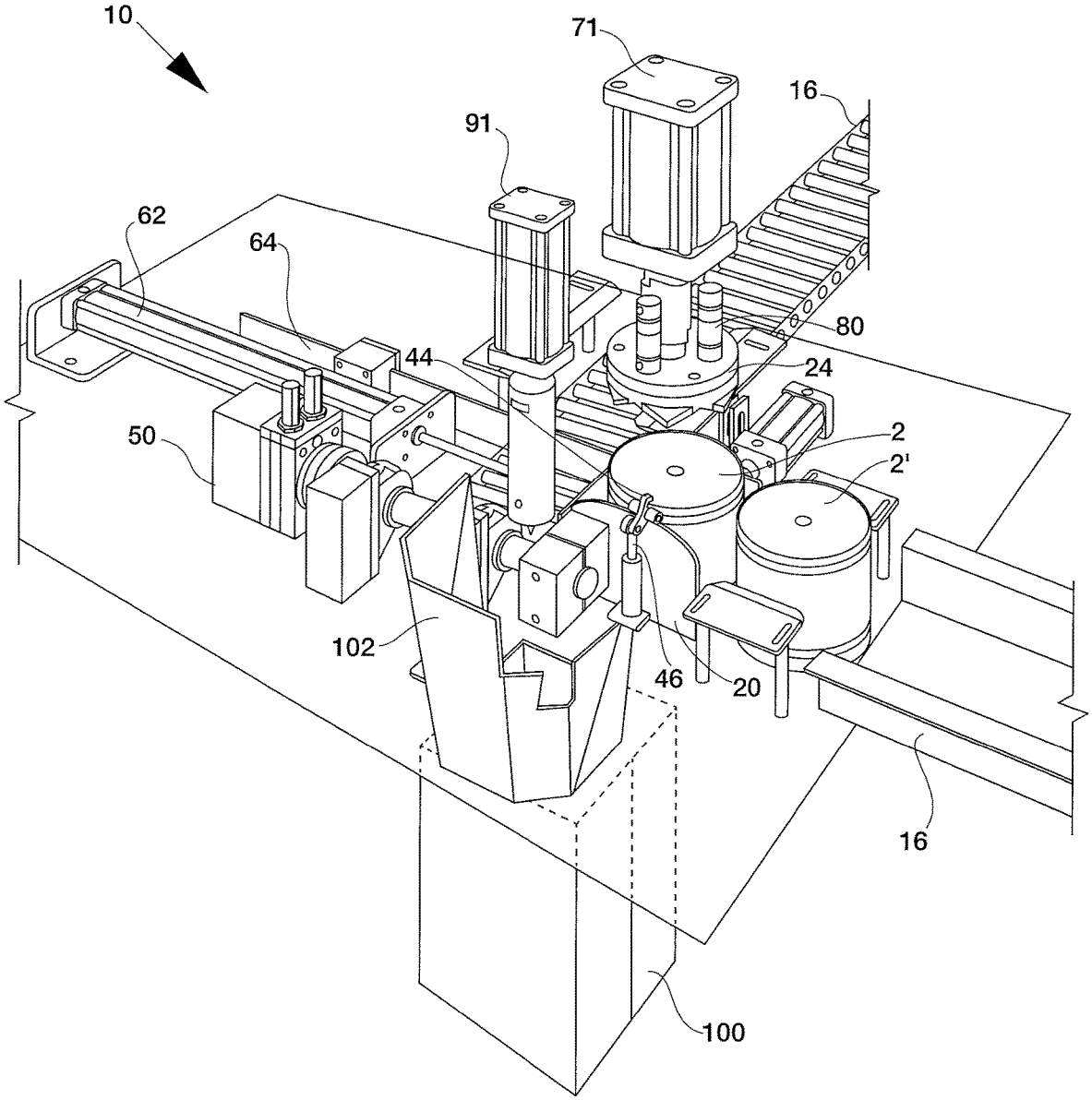
FIG. 5 is an enlarged rear perspective view of the can opening system shown in FIG. 2.

FIGS. 3-5 depict one embodiment of the can opening system 10. As cans enter the can opening system, a guide block 60 pushes a can 2 off of the gravity roller conveyor system 16 and onto the top clamping assembly 20 that aligns the can 2 directly underneath the punch cutter 24. A two-clamp system is utilized to prevent the punch cutter 24 from colliding onto a top clamp 44 as the punch cutter extends to remove the lid, while also enabling the can to be secured while rotated. A bottom clamping assembly 22 first clamps onto a bottom portion of the can 2. Once the can 2 is clamped, the punch cutter 24 extracts the lid from the can 2. After the lid is removed by the punch cutter 24, the bottom clamping assembly 22 is removed from the can 2 and the top clamping assembly 20 clamps onto a top portion of the can 2. A rotary actuator 50 connected to the top clamping assembly 22 rotates the can 2 to empty its contents through a product chute 100. A splash guard 102 may be included to guide the can's contents into the product chute 100. The product chute 100 may lead to a disposal bin or to another component of a system if the contents are to be used.

Figure 8:
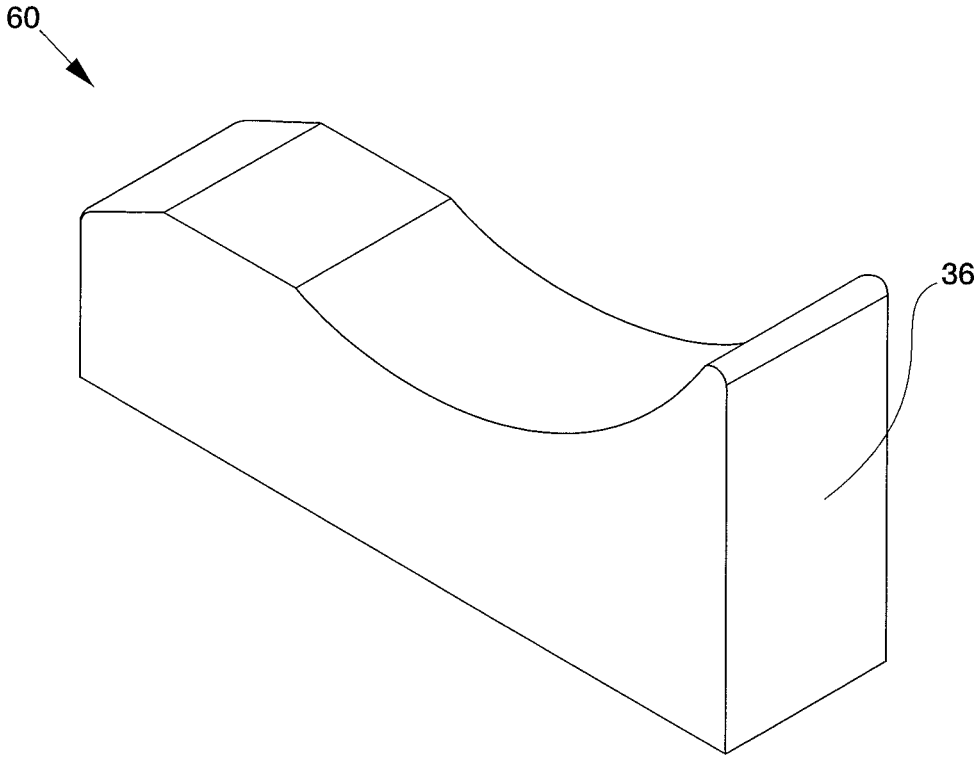
FIG. 8 is an enlarged side perspective view of a guide block.

While the can 2 is in its rotated position, a punch tip 26 punctures the bottom of the can 2. The punch tip 26 includes one or more holes 94 that expel pressurized air inside the can 2 to remove additional remaining contents from the can. The punch tip 26 is then removed and the can 2 is rotated back to its original orientation. The lid 6 is reinserted back into the can, and the guide block 60 pushes the next can into position. FIG. 8 depicts one example of a guide block 60, wherein the guide block 60 may be substantially crescent-shaped with a thick sidewall 36 for positioning the can 2.

Preferably, the can 2 is displaced from the top clamping assembly and toward the chute 18 as the next can is pushed onto the top clamping assembly 20 to reduce the time for loading the next can onto the top clamping assembly 20 and thereby increase the number of cans that may be processed per hour. Yet in another embodiment, the guide block 60 may extend to push the can 2 off of the top clamping assembly 20 and toward the chute 18 before retracting to load the next can onto the top clamping assembly.

Figure 6:
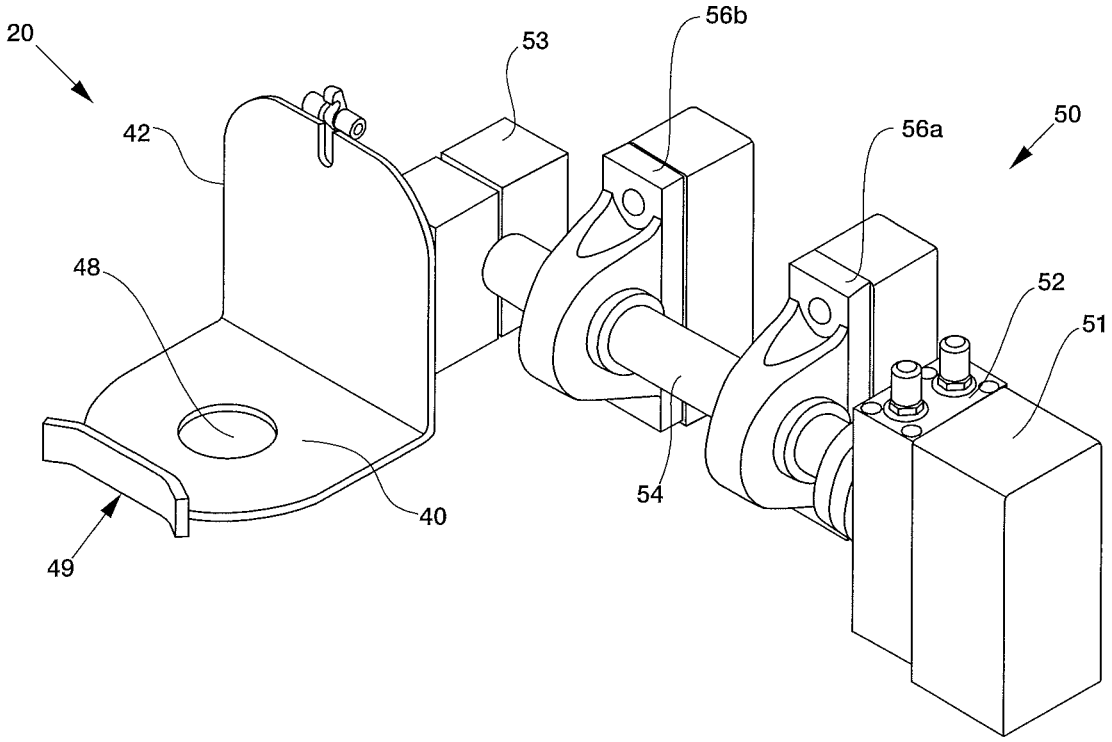
FIG. 6 is an overhead perspective view of a top clamping assembly connected to a rotary actuator.
Figure 7:
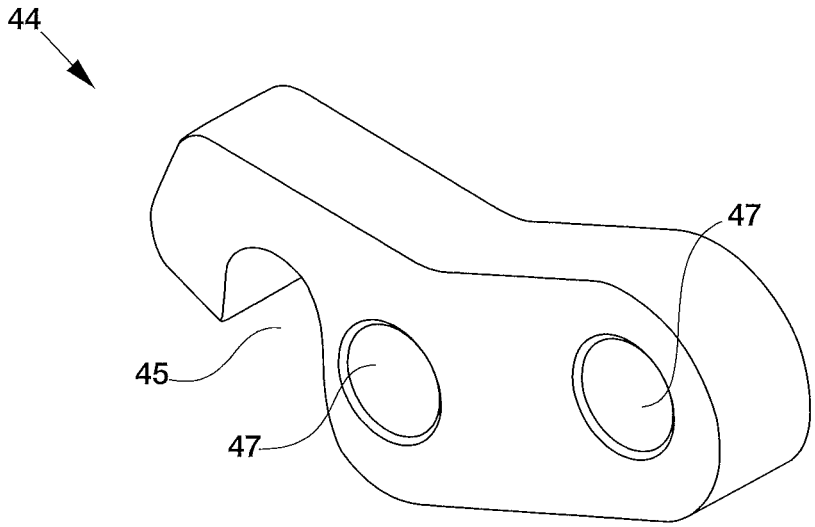
FIG. 7 is an enlarged side perspective view of a top clamp.

Turning to FIG. 6, one embodiment of a top clamping assembly 20 attached to a rotary actuator is shown. The top clamping assembly 20 comprises a floor 40 having a sidewall 42, with a top clamp 44 (seen in FIGS. 4 and 5) attached on top of a sidewall 42 adapted to attach to a top end of the can 2. In the embodiment shown, the top clamp 44 operates using a piston 46 that extends to enable the top clamp 44 to attach to the can 2. The top clamp 44 is released from the can 2 when the piston 46 contracts. FIG. 7 shows one embodiment of a top clamp 44 having a notch 45 adapted to be inserted onto the outer top lip of the can 2. Holes 47 are for mounting the top clamp 44 onto the piston 46.

The rotary actuator 50 attached to the top clamping assembly 22 enables the can 2 to be rotated in order to have its contents dispensed. In the embodiment shown in FIG. 6, the rotary actuator 50 comprises a motor 52 attached to a first mount 51 adapted to rotate a shaft 54. Rotary bearings 56*a* and 56*b* may be added along the shaft 54 to assist with its rotation. The other end of the shaft 54 is inserted into a second mount 53, wherein the second mount 53 is attached to the sidewall 42 of top clamping assembly 20.

As the motor 52 rotates the shaft 54, the top clamping assembly 20 rotates from a first position to a second position. In the embodiment shown in FIGS. 3-5, the rotary actuator 50 is configured to rotate the top clamping assembly 180 degrees, whereby the floor 40 rotates from being underneath the bottom of can 2 onto the top of can 2 (with the can being inverted). Rotating the top clamp assembly 20 also displaces it from its original position underneath the punch cutter 24 to a position underneath the punch tip 26 and above the product chute 100.

The floor 40 and sidewall 42 work in conjunction with the bottom clamping assembly 22 to facilitate positioning the can 2 underneath the punch cutter 24. The floor 40 also includes a hole 48 for the punch tip 26 to pass through and puncture the bottom of can 2 once the can is rotated. A bottom lip 49 may also be added across the floor 40 from sidewall 42 to help maintain the can's position.

The bottom clamping assembly 22 comprises a bottom clamp 30 attached to a piston 32 that positions the bottom clamp 30 toward the can 2 when extended and away from the can 2 when the piston 32 is retracted. The bottom clamp 30 is sized and shaped to partially wrap around the can 2. When the piston 32 is extended, the bottom clamp 30 pushes onto the can 2 until the can abuts the sidewall 42 of the top clamping assembly 20. Once the can 2 is in position and the top clamp 44 is clamped onto the lip, the piston 32 retracts and the bottom clamp 30 is released from the can so that it may rotate for its contents to be dispensed. After the can returns to its original orientation, the bottom clamping assembly 22 re-clamps onto the can 2 so that it is correctly positioned under the punch cutter 24 for its lid to be inserted into the can.

Preferably, the bottom clamp 22 is operated by the piston 32 at a range of between about 15 to about 20 pounds of pressure to secure the can 2 against the sidewall 42 of the top clamping assembly 20. Applying a pressure below 15 pounds may result in the can becoming displaced when the punch cutter 24 punctures the lid. For example, the can may be lifted with the punch cutter 24 after the lid is punctured and the punch cutter 24 retracts. Applying a pressure above 20 pounds may potentially damage the can 2.

Figure 9:
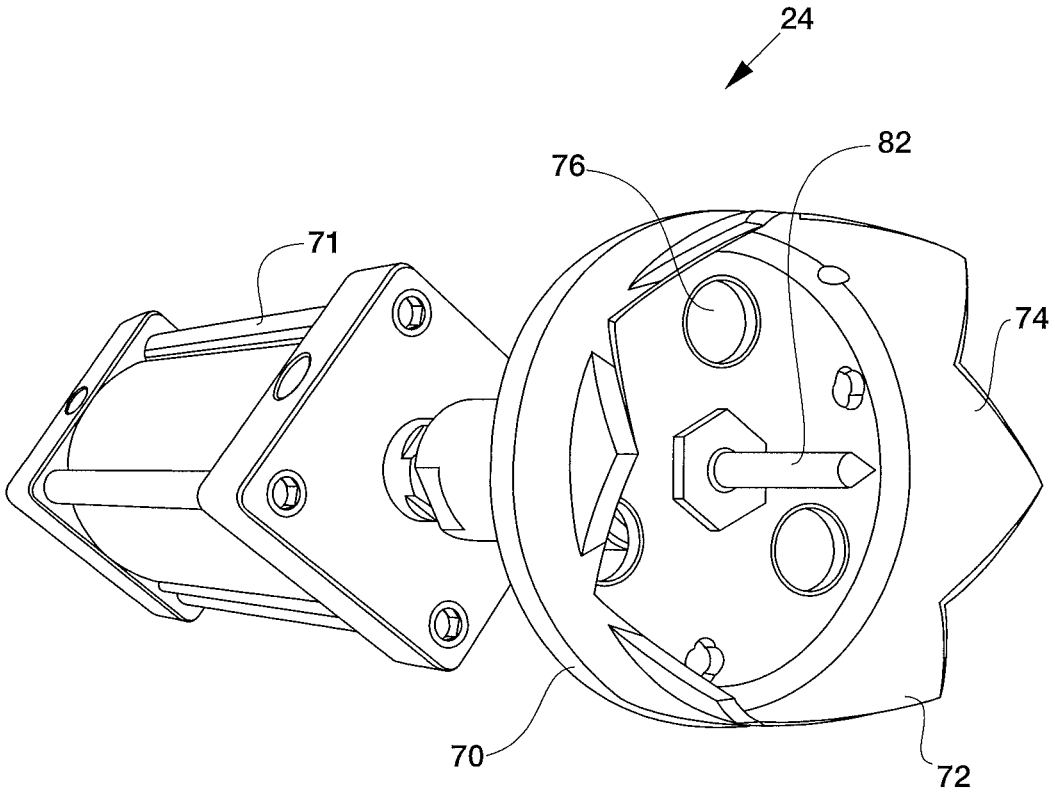
FIG. 9 is a bottom perspective view of a punch cutter assembly.
Figure 10:
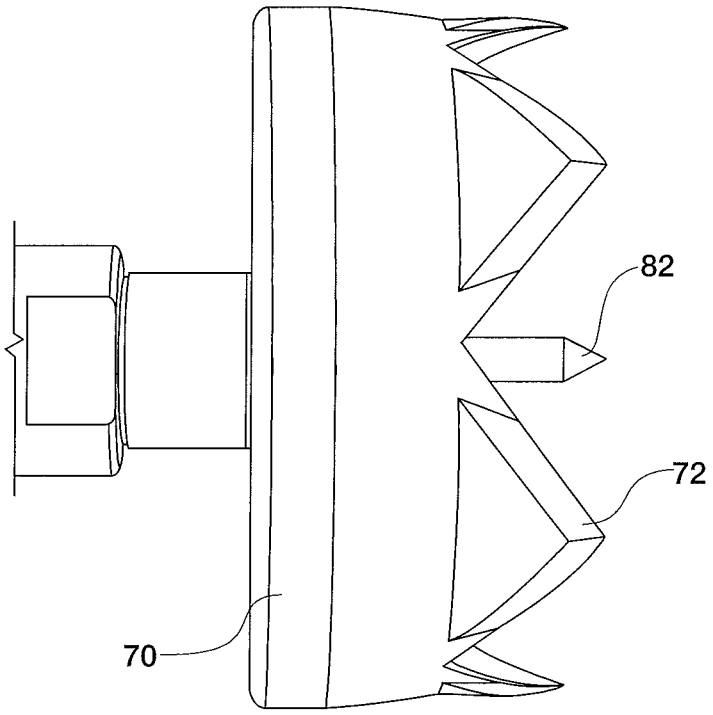
FIG. 10 is an enlarged side elevational view of the punch cutter shown in FIG. 9.

FIGS. 9 and 10 depict one example of a punch cutter 24. The punch cutter 24 comprises a plate 70 having a plurality of blades 72. In the example shown, the blades 72 are arranged around the perimeter of the plate 70 in a circular configuration and form a cavity 74 from their inner faces. The pointed edges of the blades 72 are oriented perpendicularly with respect to the plate 72, such that the blades extend downward toward the lid of a can 2.

The punch cutter 24 is connected to a piston 71 that extends to enable the blades 72 to puncture the lid of a can 2. Once the lid is cut, the piston 71 retracts and the lid is removed from the can 2. In the example shown, the lid is retained through a friction fit within the cavity 72, and remains substantially parallel with the plate 70. The plate 70 includes a plurality of holes 76. As seen in FIGS. 3-5, a pneumatic ejector cylinder 80 overlaps each hole 76. Once the contents of the can 2 are dispensed and the can is returned to its original orientation underneath the punch cutter 24, the piston 71 extends and the punch cutter 24 is at least partially reinserted into the can 2. After the punch cutter is inserted into the can 2, the ejector cylinders 80 extend through the holes 76 to remove the lid from the cavity 74, and the lid falls into the can 2. Inserting the punch cutter 24 into the can 2 ensures that the lid falls into the can, instead of possibly missing the can and landing onto the platform 13.

A punch spear 82 may be added to the plate 70 to puncture the lid of the can when the piston 71 extends. Puncturing the lid releases air from the can and prevents its contents from erupting outside the can when the blades 72 puncture through. As seen in FIG. 10, the punch spear 82 may have a length greater than the length of the blades 72, so that the lid is punctured by the punch spear 82 prior to being excised from the blades 72.

Figure 11:
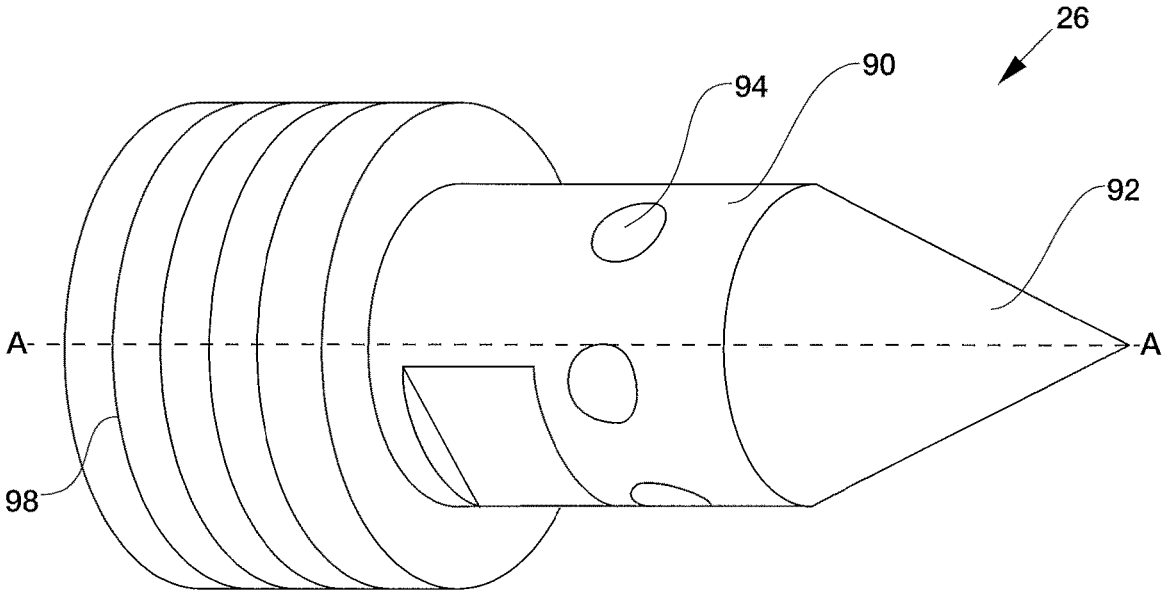
FIG. 11 is an overhead perspective view of a punch tip.
Figure 12:
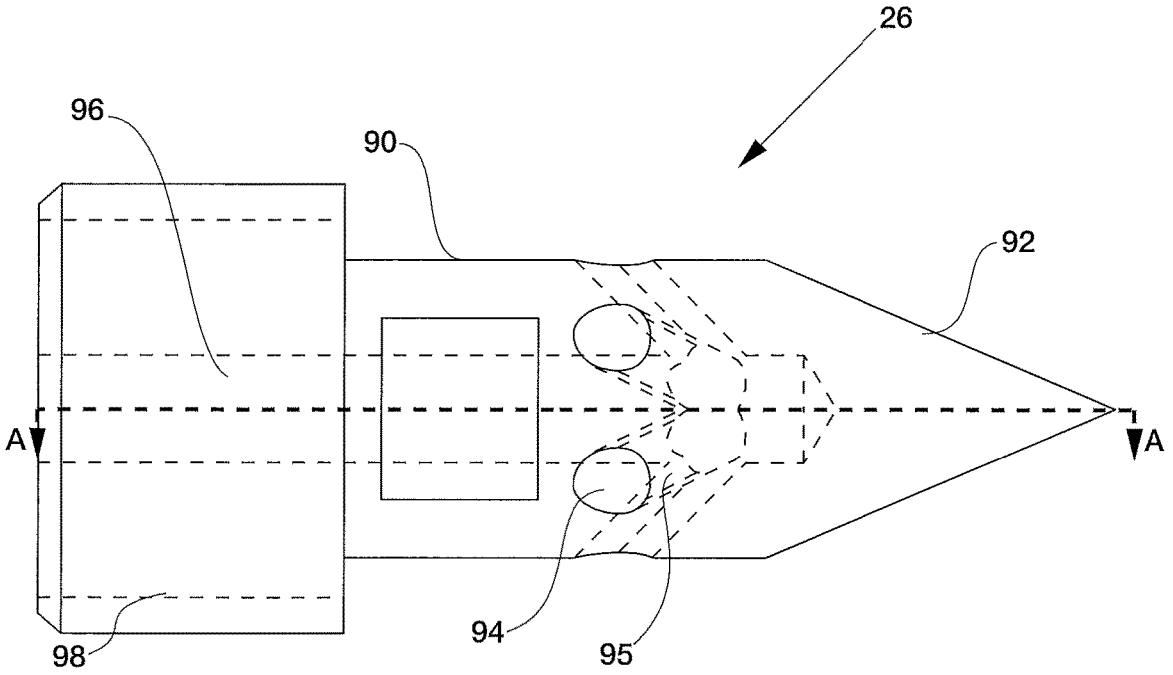
FIG. 12 is a cross-sectional view of the punch tip shown in FIG. 11.

A punch tip 26 may be added to facilitate removal of contents that remain within the can even after it is rotated, and is particularly useful for removing viscous contents within the can 2. FIGS. 11 and 12 illustrate one embodiment of a punch tip 26 adapted for expelling contents from a can 2. The punch tip 26 comprises a shaft 90 having a pointed end 92, and one or more holes 94 around the shaft 90 for expelling air into the can 2. The other end 98 of shaft 90 is connected to a piston 91 (see FIGS. 3-5) that extends to puncture the bottom of the can 2 with the punch tip 26, and contracts to remove the punch tip 26 from the can 2. A cylindrical cavity 96 runs along the length of the shaft 90 (i.e., along axis A shown in FIG. 11), and enables pressurized air to pass from an air line and through the shaft 90. The cylindrical cavity 96 terminates near the end of shaft 90 and splits into a plurality of smaller cavities 95 angled away from the cylindrical cavity 96.

In some embodiments, the smaller cavities 95 may be angled between about 10° and about 90° away from the cylindrical cavity 96. More preferably, the smaller cavities 95 may be angled between about 30° and about 60° away from the cylindrical cavity 96. In the example shown in FIG. 12, the smaller cavities 95 are angled about 45° away from the cylindrical cavity 96. The pressurized air travels through smaller cavities 95 and out through holes 94. The approximately 45° angle of the smaller cavities 95 enables the air to exit through holes 94 upward and onto the bottom of the can 2 and down its sidewalls.

Figure 13:
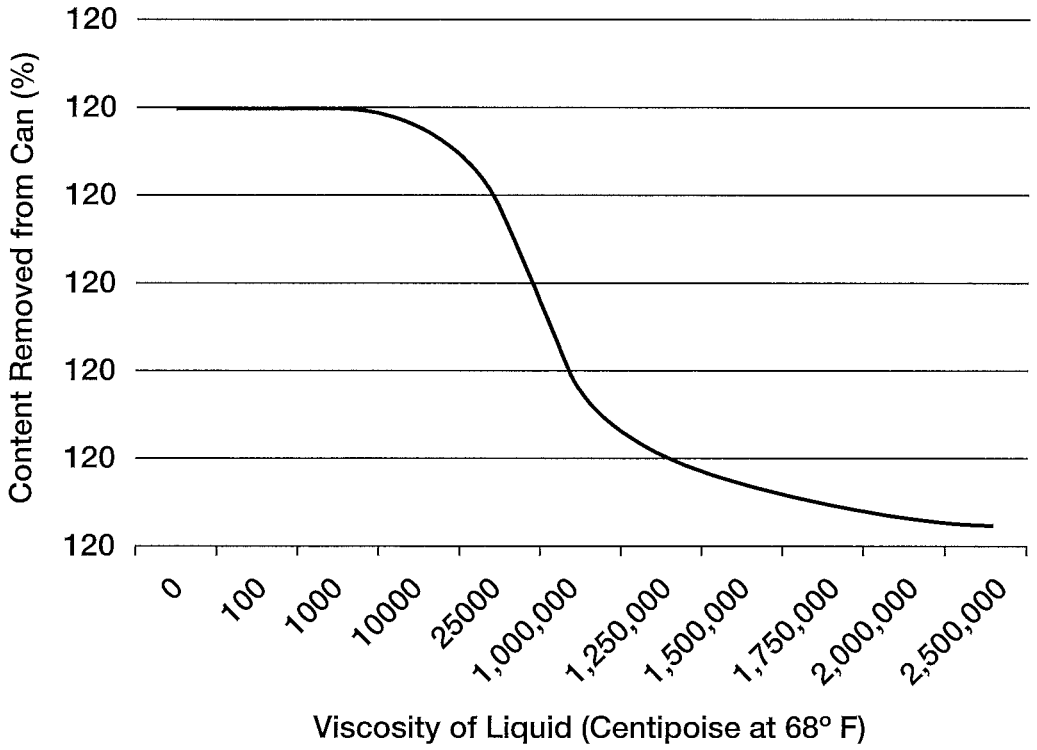
FIG. 13 is a graph illustrating the effect of viscosity on the amount of content removed by the can opening system with the punch tip expelling air at a pressure between 80-120 PSI.

FIG. 13 is a plot showing the effectiveness of expelling pressurized air from the punch tip for a range of viscosities (determined at a temperature of 68° F.). When the can contains contents having a viscosity between 0 Centipoise (Cp) and about 1,000 Cp, about 100% of the can's contents are removed when the can is rotated 180° and pressurized air in the range of about 80-120 PSI is expelled into the can from the punch tip. For ranges between about 1,000 Cp and 100,000 Cp, rotating an opened can and expelling air remains up to about 90% effective. However, as the viscosity of the contents continues to increase, expelling pressurized air at a range between about 80-120 PSI becomes less effective at removing additional content. Between about 100,000 Cp and about 250,000 Cp, up to about 75% of the total contents can be removed by rotating the opened can 180° and expelling pressurized air. At viscosities over 1,000,000 Cp, less than 20% of the total contents may be removed.

Figure 14:
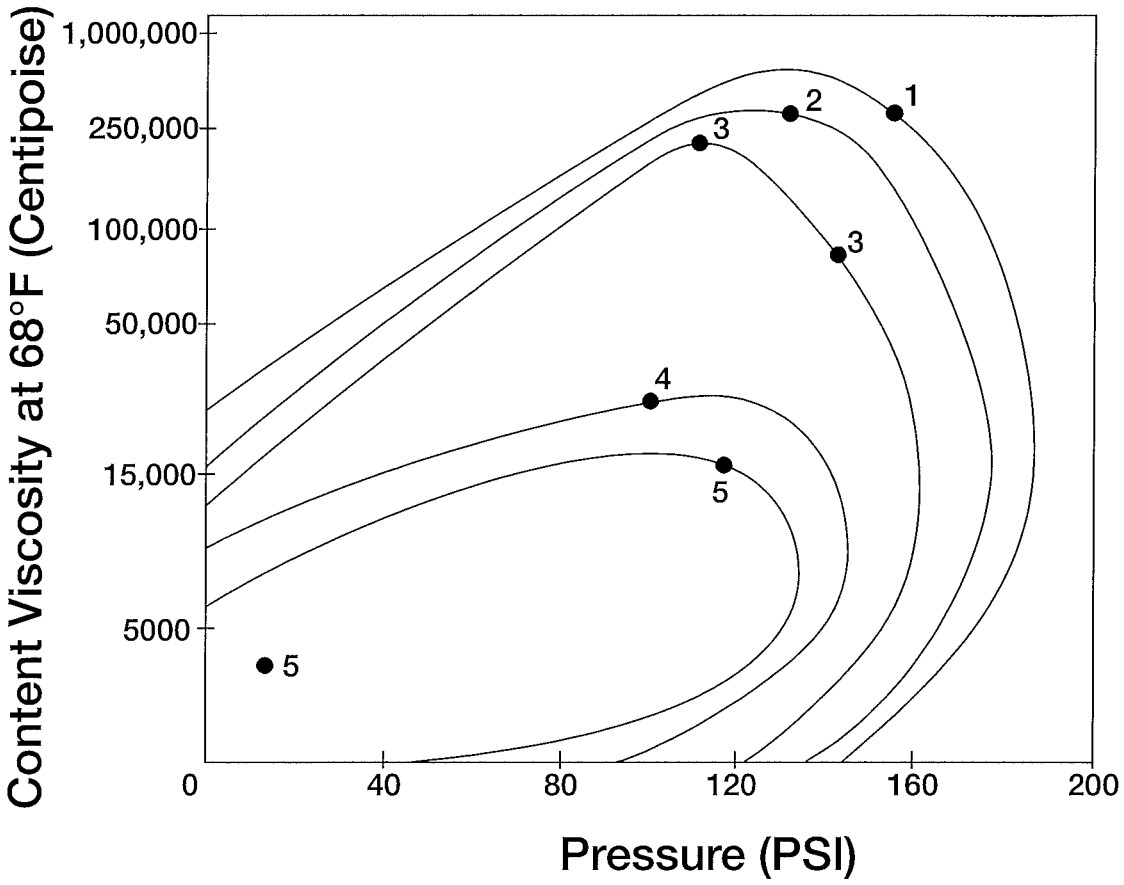
FIG. 14 is a graphical representation of a response surface illustrating the relationship of content viscosity and pressure of expelled air on effectiveness of content removal as constructed according to the present inventions.

FIG. 14 illustrates the desired relationship between the viscosity of a can's contents and the pressure of expelled air via a two-dimensional surface plot. Various viscosities and pressures are plotted and ranked from 1 to 5 indicating least to most effective for content removal. The response surface shown provides a visual illustration of the effects of both viscosity and air pressure via a two-dimensional surface plot of a three-dimensional surface. The boundary conditions in FIG. 14 are denoted with solid lines, and indicate the ideal pressures for a given range of viscosities.

Accordingly, data was plotted based on the expected effects of expelling pressurized air into the bottom of a can from a punch tip to remove excess viscous contents. FIG. 14 indicates that the most effective ranges of pressure is between about 80 PSI and about 120 PSI, with about 110 PSI being the most effective. However, various other pressures between about 60 PSI and 120 PSI were found to be effective depending on the viscosity of the can's contents. The graph also indicates that excessive pressures do not lead to greater removal of content, but instead distorts and possibly crushes parts of the can, and thus poses a pressure limit for the expelled air.

Viscosity is measured in Centipoise at about 68° F. At low viscosities, puncturing the bottom of the can with a punch tip and expelling pressurized air is optional since most of the contents can be removed by gravity alone (after the can is opened and rotated about 180°). As viscosity increases above 5,000 Cp, expelling pressurized air leads to increased content removal. Applying a pressure between about 80 PSI and about 120 PSI remains effective for removing contents having a viscosity of about 100,000 Cp, is more effective for contents having a viscosity below about 50,000 Cp, and is most effective for contents having a viscosity of about 15,000 Cp or lower. These graphs show that expelling pressurized air using a punch tip is an effective tool for assisting with the removal of contents from a can, particularly for viscous materials.

Overall, the housing's design incorporates numerous features to provide a safer alternative compared to other can opening systems. Nearly all components are housed within an outer casing, and are physically inaccessible to an individual while the machine is in operation. The outer casing 15 includes a time-delayed interlocked door 19, such as a door including a GUARDMASTER® interlock switch offered by Allen-Bradley to prevent the door from opening during operation. The time-delayed interlocked door 19 is useful to prevent access to components while the can opening system is in operation, and also to ensure that air pressure from all pneumatic ejector cylinders is released prior to an operator's access.

Figure 15:
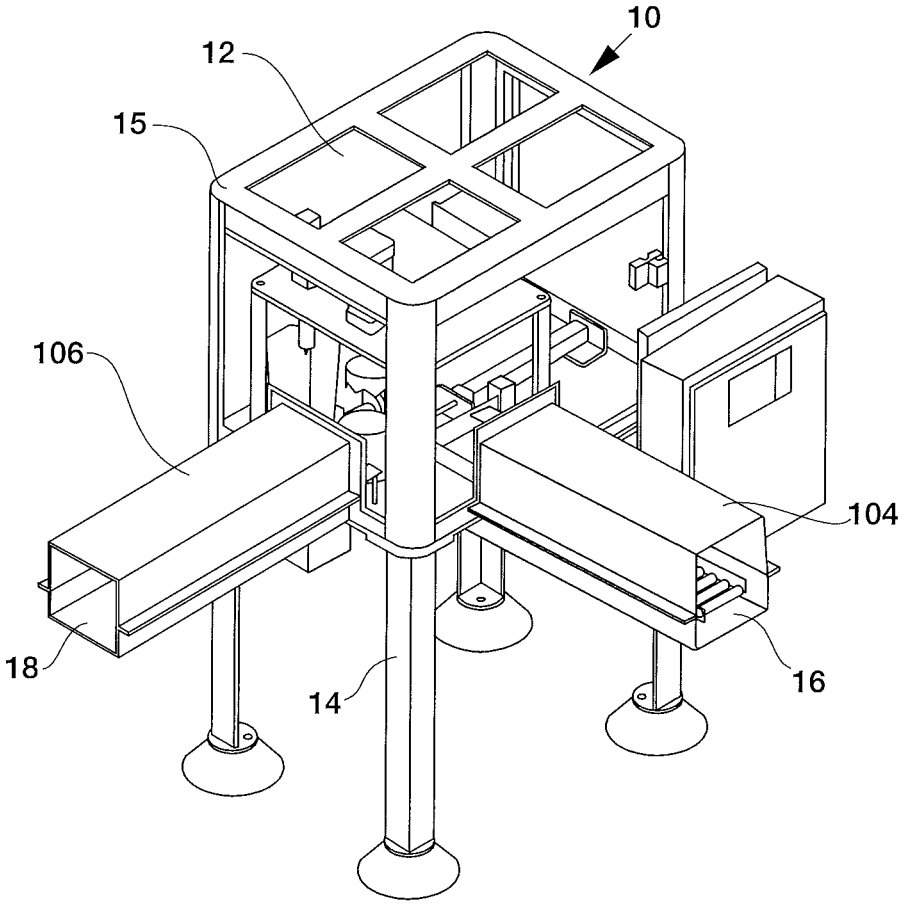
FIG. 15 is an overhead perspective view of a can opening system constructed according to one embodiment of the present inventions.
Figure 16:
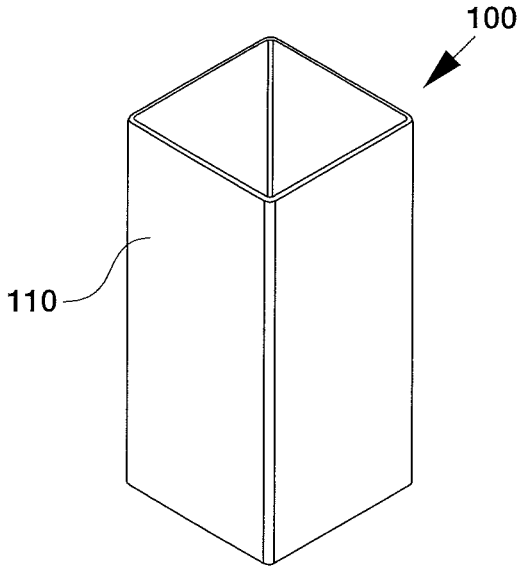
FIG. 16 is an enlarged overhead perspective view of a product chute according to one embodiment.
Figure 17:
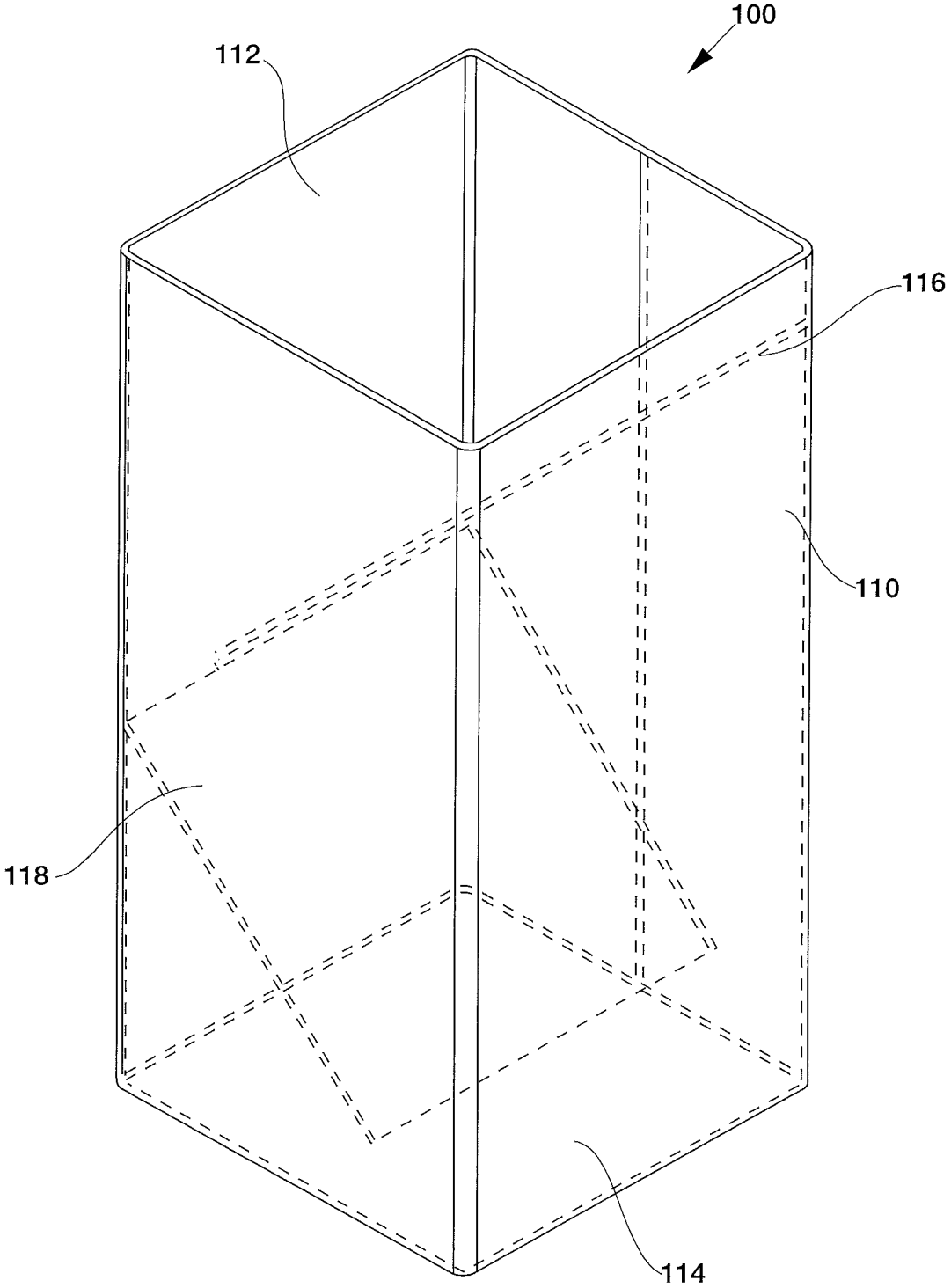
FIG. 17 is an overhead perspective view of a product chute shown in FIG. 16 with the contents concealed the housing shown in dashed lines.
Figure 18:
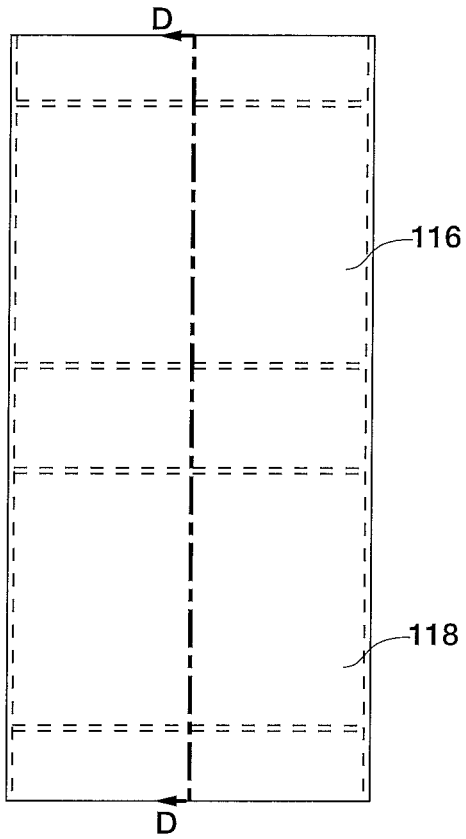
FIG. 18 is a side elevational view of the product chute shown in FIG. 16.
Figure 19:
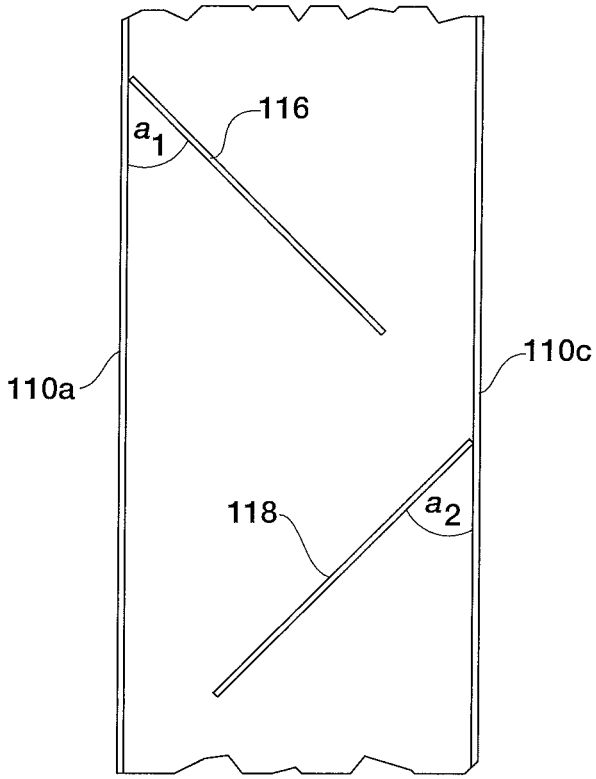
FIG. 19 is a cross-sectional view of the product chute shown in FIG. 18.
Figure 20:
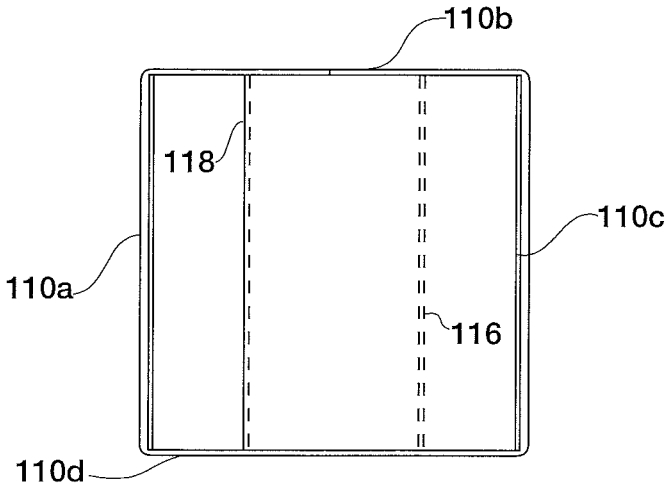
FIG. 20 is a bottom view of the product chute shown in FIG. 16, the opposite view being a mirror image thereof.

As seen in FIG. 15, both the gravity roller conveyor system 16 and the chute 18 may further include coverings 104 and 106, respectively, to prevent an individual from reaching inside the outer casing 15 (for example, through opening 17). In one embodiment, the chute and gravity roller conveyor system each comprise a length of about 34 inches or greater and including a stainless steel covering to prevent an individual reaching inside the outer casing.

Similarly, the product chute 100 may comprise a length of about 34 inches or greater to prevent an individual from reaching into the components housed within the outer casing 15. In an alternative embodiment designed to reduce the can opening system's overall height, the product chute 100 comprises a box 110 having an opening 112 for the can contents to enter the product chute from within the outer casing 15 and an exit 114 for the contents to enter a disposal bin or a component of another system for further use. A plurality of angled guards are included within the box 100 to obstruct an individual's access to the outer casing's inner components while simultaneously enabling the can's contents to travel through the product chute 100 to the exit 114. As a result, the box 100 may have a length less than 34 inches since the guards prevent an individual from reaching inside the outer casing.

One embodiment of the product chute design is shown by FIGS. 16-20. A first guard 116 is placed at a first angle $a_1$ near the opening 112, and a second guard 118 is placed at a second angle $a_2$ near the exit 114. The first and second angles may be equal or may differ from one another. In the embodiment shown in FIG. 19, the first guard 116 is attached to a sidewall 110*a* and the second guard is attached to an opposing sidewall 110*c*. Both the first and second angles of the guards are approximately 45°. By decreasing the length of the product chute 100, the legs 14 can adopt a lower length thereby lowering the overall height of the can opening system.

The present inventions also include methods for processing cans. For example, the method may comprise steps for opening a can and removing its contents. The steps may include clamping a bottom portion of a can, removing a lid from the can, clamping a top portion and rotating the can to empty a majority of its contents, puncturing the bottom portion with a punch tip, expelling air from one or more holes on the punch tip to remove additional contents from the can, and rotating the can to its original orientation.

The method may comprise loading a plurality of cans into a can opening assembly with a conveyor system. In one embodiment of the disclosure, the method may comprise aligning a first can from the plurality of cans under a cutter adapted to cut and remove a lid from the first can, and may also include a step for pushing the first can away from the cutter after its contents are removed and aligning a second can under the cutter.

The can may be rotated about 180 degrees to empty the majority of the can's contents. For example, rotating the can to empty a majority of its contents may comprise removing between about 50% to about 80% of the contents of the can. The method may include the step of retaining the lid when removing the lid from the can, and may also include inserting the lid inside of the can after rotating the can to its original orientation. Once the can is opened and its contents are dispensed, the method may further comprise disposing of the can and the lid into a single bin.

The methods may include steps for removing viscous contents from a can. In one example, air may be expelled from one or more holes of the punch tip at a pressure between about 80 PSI and about 120 PSI. For instance, the air may be expelled at a pressure of about 110 PSI. Expelling air from the one or more holes on the punch tip may remove up to 90% of the total contents of the can. For example, contents having a viscosity of between about 0 to about 250,000 Centipoise at 68° F. may have up to about 90% of the contents removed. For instance, about 90% of the contents removed has a viscosity between about 1 to about 20,000 Centipoise at 68° F. In another example, about 75% of the contents removed has a viscosity between about 100,000 to about 250,000 Centipoise at 68° F.

In one embodiment of the method, cans enter the outer casing 15 of the can opening system 10 through a gravity roller conveyor system 16. As the cans enter the housing 12, a piston 62 extends a guide block 60 to push a can 2 off of the gravity roller conveyor system 16 and onto the floor 40 of the top clamping assembly 20 aligned directly underneath the punch cutter 24. The guide block then slightly retracts, and includes a stop 64 preventing additional cans from entering further.

Figure 21:
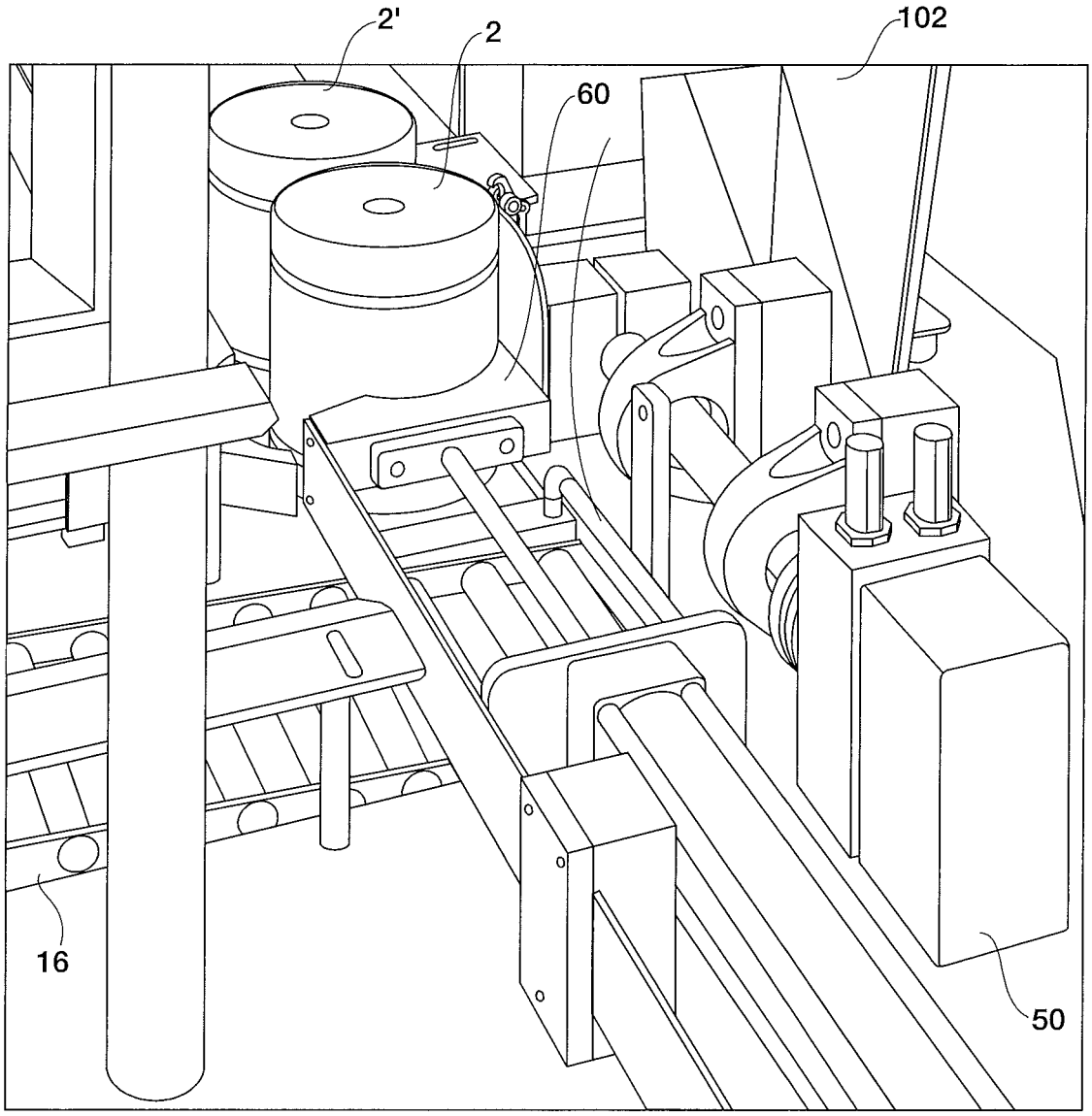
FIG. 21 is an enlarged side perspective view of another embodiment of a can opening system.

In another embodiment, as seen in FIG. 21, cans enter the outer casing 15 of the can opening system 10 through a gravity roller conveyor system 16. As the cans enter the housing 12, a can reaches a stop 64 comprising a rod. The stop 64 is positioned so that the can 2 is directly in front of the guide block 60, whereby the guide block 60 is adapted to push a can 2 off of the gravity roller conveyor system 16 without colliding onto the adjacent can behind can 2. The can 2 is pushed onto the floor 40 of the top clamping assembly 20 by the guide block 60 and aligned directly underneath the punch cutter 24. The guide block 60 then retracts away from can 2.

Once the can is placed onto the top clamping assembly 20, a bottom clamping assembly 22 clamps onto a bottom portion of the can 2 and pushes the can 2 against the sidewall 42 of the top clamping assembly. The top clamping assembly 20 includes a floor 40 with a lip 49 to help retain the can 2 on the top clamping assembly 20.

Once the can 2 is secured onto the top clamping assembly 20 by the bottom clamp 30, the punch cutter 24 extends to extract the lid from the can 2. The punch cutter 24 includes a punch spear 82 that initially punctures the lid as the punch cutter 24 approaches the lid. As a piston 71 extends the punch cutter 24, the blades 72 cut the lid and the lid is retained within a cavity 24 formed by the blades 72. The piston 71 then retracts the punch cutter 24 and the lid is removed from the can 2.

After the lid is removed from the can 2, the bottom clamp 30 retracts from the can 2 and the top clamp 44 clamps onto a top portion of the can 2. A rotary actuator 50 connected to the top clamping assembly 20 rotates the can 2 to empty its contents. As the can 2 is rotated, it is positioned underneath a punch tip 26 and above a product chute 100. A splash guard 102 may be included to guide the can's contents into the product chute 100. Gravity causes at least a portion of the can's contents to fall into the product chute 100.

If desired, a piston 91 may extend the punch tip 26 through a hole 48 on the floor 40 to puncture through the bottom of a can 2. Pressurized air is then expelled from the punch tip 26 through holes 94 and into the can 2. The pressurized air enables contents remaining within the can 2 to fall into the product chute 100. The piston 91 then retracts the punch tip 26 from the can 2, and the rotary actuator 50 rotates the can 2 back underneath the punch cutter 24.

The top clamp 44 is removed from the can 2 and the bottom clamp 30 re-secures the can 2 onto the top clamping assembly 20. The piston 71 then extends the punch cutter 24 back into the can 2. One or more pneumatic ejector cylinders 80 extend through the holes 76 on the top plate 70 of the punch cutter to push the lid from the cavity 74 and into the can 2.

The bottom clamp 30 retracts and then the can 2 is removed from the top clamping assembly 20 and toward the chute 18. Preferably, the guide block 60 pushes a second can from the gravity roller conveyor system onto the top clamping assembly 20, whereby the second can displaces the can 2 from the top clamping assembly 20 and toward the chute 18. Alternatively, the guide block 60 extends to displace the can 2 off of the top clamping assembly 20 and toward the chute 18. The guide block 60 then retracts to enable the next can to proceed further into the housing, and then extends to push the next can onto the top clamping assembly 20. From there, the process may then be repeated.

In operation, the combination of can opening elements disclosed herein enables a more efficient system whereby the can opening system can process up to about 450 cans per hour. Moreover, the arrangement of the system's components allows the can opening system to occupy a space of approximately 42 square feet.

Certain modifications and improvements will occur to those skilled in the art upon a reading of the foregoing description. By way of example, the can opening system and methods described herein may be adapted for cans of any size and shape. Additional steps may be included before and after the process. For example, the cans may be rinsed prior to entering the outer casing, and the cans may be crushed after exiting the housing. Moreover, the punch tip may be used to expel air even if the can does not contain viscous materials. It should be understood that all such modifications and improvements have been deleted herein for the sake of conciseness and readability but are properly within the scope of the following claims.

We claim:

1. A can opening system for removing contents of a plurality of cans comprising:

a housing adapted to receive a can and shield an operator from equipment within the housing, a top clamping assembly within the housing adapted to clamp onto a top edge of the can, a bottom clamping assembly within the housing configured to clamp against a lower side of the can, a punch cutter above the top and bottom clamping assemblies for extracting and retaining a lid of the can, and a punch tip within the housing adapted to puncture a bottom of the can and dispense a remaining content of the can.

2. The can opening system according to claim 1, wherein the bottom clamping assembly comprises a bottom clamp attached to a piston configured to extend and clamp the can when the can is initially positioned below the punch cutter and configured to contract and release the can after the lid is removed.

3. The can opening system according to claim 2, wherein the bottom clamp is substantially crescent-shaped.

4. The can opening system according to claim 1, wherein the top clamping assembly includes a floor adapted to be positioned below the can, a sidewall having a height substantially equal to a height of the can and a top clamp on top of the sidewall.

5. The can opening system according to claim 4, wherein the top clamp is attached to a piston that extends to clamp the can and contracts to release the top clamp from the can.

6. The can opening system according to claim 4, wherein the floor includes a hole adapted for the punch tip to extend through.

7. The can opening system according to claim 1, wherein the top clamping assembly is attached to a rotary actuator adapted to rotate the top clamping assembly with the can 180 degrees.

8. The can opening system according to claim 7, wherein the top clamping assembly comprises a notch adapted for receiving a lip on the top edge of the can.

9. The can opening system according to claim 1, further including a gravity roller conveyor system adapted to insert a plurality of cans into the housing.

10. The can opening system according to claim 9, further including a chute for the plurality of cans to exit the housing.

11. The can opening system according to claim 10, further including a guide block to guide the can onto the chute after the can is opened and dispensed.

12. The can opening system according to claim 11, further including a stop on the guide block adapted to prevent a second can from displacing the can.

13. The can opening system according to claim 1, wherein the punch cutter comprises a plate with a plurality of blades arranged perpendicularly from the plate in a crown-like configuration and forming a cavity, whereby the lid is retained within the cavity formed from the plurality of blades after the lid is removed from the can.

14. The can opening system according to claim 13, wherein the punch cutter includes six blades.

15. The can opening system according to claim 13, further including a hole on the plate and an ejector cylinder overlapping the hole on the plate, wherein the ejector cylinder is adapted to extend through the hole on the plate to release the lid from the plurality of blades.

16. The can opening system according to claim 13, further including a punch spear attached to a center of the punch cutter, wherein the punch spear is adapted for puncturing the lid to release air from the can and prevent overspray of its contents.

17. The can opening system according to claim 1, further including one or more holes on the punch tip adapted to expel air and remove additional contents from the can.

18. The can opening system according to claim 1, further including a time-delayed interlocked door on the housing.

19. The can opening system according to claim 1, wherein the can is a #10 can.

20. A method for processing cans using the system of claim 1 comprising:

clamping a lower portion of a can in an original orientation, removing a lid from the can, clamping an upper portion of the can, rotating the can into an off-centered position thereby emptying a first portion of its contents, puncturing the lower portion with the punch tip, expelling air from one or more holes on the punch tip to remove additional contents from the can, and rotating the can to its original orientation.

21. The method according to claim 20, further comprising retaining the lid when removing the lid from the can.

22. The method according to claim 21, further comprising inserting the lid inside of the can after rotating the can to its original orientation.

23. The method according to claim 22, further comprising disposing of the can and the lid into a single bin.

24. The method according to claim 20, wherein the can is rotated about 180 degrees from a first orientation to the off-centered orientation to empty the majority of the can's contents.

25. The method according to claim 20, wherein expelling air comprises expelling air at a pressure between about 80 PSI and about 120 PSI.

26. The method according to claim 25, wherein expelling air comprises expelling air at a pressure about 110 PSI.

27. The method according to claim 20, further comprising loading a plurality of cans into a can opening assembly with a gravity feed conveyor system.

28. The method according to claim 27, further comprising aligning a first can from the plurality of cans under a cutter adapted to cut and remove a lid from the first can.

29. The method according to claim 28, further comprising pushing the first can away from the cutter after its contents are removed and aligning a second can under the cutter.

30. The method according to claim 27, wherein the can opening assembly is adapted to process about 450 cans per hour.

31. The method according to claim 20, wherein rotating the can to empty the first portion of its contents comprises removing between about 50% to about 80% of the contents of the can.

32. The method according to claim 20, wherein expelling air from the one or more holes on the punch tip removes up to 90% of a total contents of the can.

33. The method according to claim 32, wherein up to about 90% of the contents removed has a viscosity of between about 0 to about 250,000 Centipoise at 68° F.

34. The method according to claim 33, wherein about 90% of the contents removed has a viscosity between about 1 to about 20,000 Centipoise at 68° F.

35. The method according to claim 33, wherein about 75% of the contents removed has a viscosity between about 100,000 to about 250,000 Centipoise at 68° F.

* * * * *